US005295669A

United States Patent [19]

Campana

[11] Patent Number: 5,295,669

[45] Date of Patent: Mar. 22, 1994

[54] REFRACTORY COATED IRON-BASED PIPE

[75] Inventor: Patsie C. Campana, Lorain, Ohio

[73] Assignee: Caldo International, Inc., Lorain, Ohio

[21] Appl. No.: 966,737

[22] Filed: Oct. 26, 1992

[51] Int. Cl.[5] ..... C21C 5/32; C21B 7/16

[52] U.S. Cl. ..... 266/265; 75/533

[58] Field of Search ..... 266/265; 75/533

[56] References Cited

U.S. PATENT DOCUMENTS 4,783,057 11/1988 Sullins ..... 75/533

*Primary Examiner*—Peter D. Rosenberg

*Attorney, Agent, or Firm*—Fay, Sharpe, Beall, Fagan, Minnich & McKee

[57] ABSTRACT

A thermally stable refractory coating for iron-based piping and a method of forming the same is provided. The refractory coating comprises from about 30 to about 35 weight percent sodium silicate; from about 31 to about 36 weight percent course silica, about 80 to about 200 mesh; from about 12 to about 16 weight percent fine silica, about 325 to about 400 mesh; from about 1 to about 6 weight percent hydrated aluminum silicate clay; from about 1 to 4 weight percent graphite; from about 0.8 to about 0.9 weight percent sodium aluminate; and, from about 3 to about 5 weight percent magnetite M.S-200.

The invention also concerns a method of forming the above-described coating on iron-based piping.

16 Claims, No Drawings

REFRACTORY COATED IRON-BASED PIPE

BACKGROUND OF THE INVENTION

It is known in the iron and steel industry to use iron-based pipes, or lances, to purge slag material from ladles of molten iron or steel by forcing oxygen into the molten material. Inherent in this process, however, is the problem of degradation and corrosion of the iron-based pipes as a result of the harsh operating environment. For instance, the pipes are partially submerged in molten iron or steel, the temperature of which may be as high as 3200° F. Further, thermal shock and other stresses are encountered, as well as the action of the slag material and molten metal itself which proves to be corrosive.

Consequently, the average life of the typical iron-based pipe used for this procedure is very limited. Others have attempted to correct this problem by coating the pipe with ceramic material. This, however, has drawbacks of its own.

It has now been discovered that a coating of the type described herein can be applied and bonded to iron-based pipe to be used in iron and steel working resulting in the increased life of the pipe. The subject invention concerns a thermally stable coating, for iron-based pipes used in the iron and steel industry, which increases the operable life of the pipes which must function in extremely harsh conditions with respect to high temperature, thermal shock and other various physical, mechanical and chemical stresses.

The coating includes fine and coarse grade silica, clay, binder material, and other various components which form a vitrified, continuous shell over all exposed surfaces of an iron-based pipe, enhancing the life of the pipe by up to as much as seven times that of an uncoated pipe used in the same application.

SUMMARY OF THE INVENTION

The invention disclosed herein relates to an iron-based pipe having deposited thereon a thermally stable refractory coating, the coating comprising a mixture of coarse silica sand particles having an average particle size ranging from about 80 mesh to about 200 mesh and fine silica sand particles having an average particle size ranging from about 325 mesh to about 400 mesh and at least one type of clay binder material.

The invention further relates to the thermally stable refractory coating and to a method of forming the same.

DESCRIPTION OF THE INVENTION

Coated pipes produced according to the present invention are fabricated by first forming a mixture of silica sands, clay, binder material, and other various components. More specifically, the coating includes from about 30 to about 35 weight percent sodium silicate; from about 31 to about 36 weight percent coarse silica, about 80 mesh; from about 12 to about 16 weight percent fine silica, about 325 mesh; from about 1 to about 6 weight percent hydrated aluminum silicate clay, or M-79 clay; from about 1 to about 4 weight percent graphite; from about 0.8 to about 0.9 weight percent sodium aluminate; and, from about 3 to about 5 weight percent magnetite M.S-200. The foregoing is mixed with 18.2 pounds of water to form a suspension. More water may be added during the coating process if necessary.

The dry sodium aluminate may be replaced with liquid sodium aluminate.

The sodium silicate functions as a binder for the coating mixture. Therefore, while it is critical to the mixture, the exact amount used is not critical, as long as sufficient binder is provided to maintain the continuity of the aggregate material.

The fine and coarse grain silica material should be used in amounts which balance or compliment each other, the purpose of using both being to enhance packing of the material. The clay component coats the silica particles and helps to maintain the silica in suspension during processing.

The graphite component, while optional with respect to the coating per se, is nonetheless important as a processing aide in the finished product, enhancing the ease with which the coated pipe can be machined or handled. It also functions to dissipate heat.

The sodium aluminate aids in the reaction of the mixture components. The magnetite component enhances the adhesive or bonding properties of the coating. Thickeners, such as fiberglass, carbon or graphite may be added to the solution, or water may be added to the solution, depending on the desired characteristics to be achieved.

The coating described hereinabove is intended to increase the working life of iron-based pipes, such as the lances, used to inject oxygen into blast furnaces to expunge slag materials. These pipes, therefore, must withstand the very high temperatures encountered when contacted with molten iron and steel, up to about 3200° F. Further, the pipes must withstand sudden changes in temperature (thermal shock) and other various stresses. Also, they must be able to withstand the action of slag and of the molten metals. Pipes coated according to the subject invention with the subject coating solution remain functional for up to seven times as long as the same pipe in the uncoated state.

The coating components can be combined to form the coating mixture by any conventional mixing technique known to those skilled in the art, such as by Eiriech Mixer, which spins and folds the mixture.

The iron-based pipe may range in size from ¼ inch pipe to 20 inch pipe or larger. The pipe need not have a flat or smooth surface. Methods of application of the coating to the pipe include submerging the pipe completely in a solution bath, pumping the solution through the pipe interior and allowing it to run down over the outside surface of the pipe, or spraying the coating solution onto and into the pipe. Regardless of the method of application, it is important that the finished coating be continuous, without cracks or breaks in the coating. A coating of up to about 15 mils may be deposited. Preferably, the coating is about 7–10 mils thick. The desired coating thickness can be achieved by repeating the complete coating process, including drying stages, if the initial coating process does not produce a coating of sufficient thickness.

Once coated, the iron-based pipe must go through a drying process to eliminate the water content, as the presence of water in the finished coating tends to cause spalling of the coating. The first stage of this drying process is a thirty minute cycle at temperatures from approximately 150° F. to 250° F. After this initial drying stage, the coated pipe is then baked for approximately one hour at 600° F. to eliminate any remaining moisture and to initiate vitrification of the coating and bonding of the coating to the pipe. During this second drying stage, the coating becomes "waterproof", containing no greater than 0.5% water. If the water is not removed from the coating, when the pipe comes into contact with the molten metal, the water is volatilized within the coating causing the coating to spall.

The following examples set forth the typical means of fabricating an iron-based pipe coated with the subject inventive coating.

EXAMPLE 1

A batch of the coating solution of the subject invention was prepared by mixing 75 pounds of sodium silicate, purchased from Young Chemical; 76 pounds of 80 mesh silica purchased from U.S. Silica Company; 33 pounds of 325 mesh silica from Mobay Corporation; 6 pounds of M-79 clay, also from Mobay Corporation; 3 pounds of graphite available from Superior Graphite Company; 2 pounds of sodium aluminate purchased from Mobay Corporation; and, 11 pounds of Magnetite M.S-200 available from Chemalloy Company. The foregoing components were mixed with 18.2 pounds of water to form a suspension solution.

An iron-based pipe was then coated with the solution by submerging the entire pipe in a tank full of the solution. In this manner, the entire interior and exterior surfaces of the pipe were coated with the solution.

After the pipe had been coated with the solution, it was necessary for the pipe to go through an initial drying stage to eliminate water. The drying temperature was between 150° F. and 250° F. and the drying cycle lasted approximately 30 minutes.

After the initial drying stage, the coated pipe was baked in an oven for one hour at 600° F. During the first half hour, the temperature was ramped up to the 600° F. maximum temperature, and during the second half hour, the temperature was held at 600° F.

The coated pipe was then allowed to cool down at room temperature over a period of approximately 2 hours.

EXAMPLE 2

A coating solution was prepared as in Example 1 above. In this Example 2, an iron-based pipe was coated by pumping the coating solution up through the center of the pipe, held in a vertical position, and letting it overflow on the outside of the pipe, allowing the force of gravity to drip the solution down the pipe exterior. The coating formed was approximately 7-10 mils.

The same drying schedule was used for this pipe as for that in Example 1, i.e. the pipe was first subjected to drying at a temperature of 150° F. to 250° F. for thirty minutes and then was dried at 600° F. for at least one hour.

Pipes coated by both processes were evaluated against uncoated pipes and found to outlast the uncoated pipes. From the foregoing, it is clear that a new and superior refractory coating for iron-based pipe has been provided which exhibits desirable properties not found in prior art coatings.

While there have been described what are at present considered to be the preferred embodiments of this invention, it will be obvious to those skilled in the art that various changes and modifications may be made therein without departing from the invention; and it is, therefore, aimed in the appended claims to cover all such changes and modifications as fall within the true spirit and scope of the invention.

Having described the invention, the following is claimed:

1. An iron-based pipe having deposited thereon a thermally stable refractory coating, said coating comprising a mixture of coarse silica sand particles having an average particle size ranging from about 80 mesh to about 200 mesh and fine silica sand particles having an average particle size ranging from about 325 mesh to about 400 mesh and at least one type of clay binder material, said coating being deposited on the internal surfaces of said pipe, or on the external surfaces of said pipe, or on both the internal and external surfaces of said pipe.

2. The iron based pipe of claim 1 wherein said coating comprises from about 30 to about 35 weight percent sodium silicate; from about 31 to about 36 weight percent 80 mesh silica; from about 12 to about 16 weight percent 325 mesh silica; from about 1 to about 6 weight percent hydrated aluminum silicate; from about 1 to about 4 weight percent graphite; from about 0.8 to about 0.9 weight percent sodium aluminate; from about 3 to about 5 weight percent magnetite; and, from about 6 to about 10 weight percent water upon mixing.

3. The iron based pipe of claim wherein said coating comprises about 33 weight percent sodium silicate; about 34 weight percent 80 mesh silica; about 15 weight percent 325 mesh silica; about 3 weight percent hydrated aluminum silicate; about 1 weight percent graphite; about 0.9 weight percent sodium aluminate; about 5 weight percent magnetite; and, about 8 weight percent water.

4. A thermally stable refractory coating comprising a mixture of course silica sand particles having an average particle size ranging from about 80 mesh to about 200 mesh and fine silica sand particles having an average particle size ranging from about 325 mesh to about 400 mesh and at least one type of clay binder material.

5. The thermally stable refractory coating of claim 4 wherein said coating comprises sodium silicate, 80 mesh silica, 325 mesh silica, and hydrated aluminum silicate.

6. The thermally stable refractory coating of claim 4 wherein said coating further comprises graphite.

7. The thermally stable refractory coating of claim 4 wherein said coating further comprises sodium aluminate.

8. The thermally stable refractory coating of claim 4 wherein said coating further comprises magnetite.

9. The thermally stable refractory coating of claim 4 wherein said coating further comprises water.

10. The thermally stable refractory coating of claim 4 wherein said coating comprises from about 30 to about 35 weight percent sodium silicate; from about 31 to about 36 weight percent 80 mesh silica; from about 12 to about 16 weight percent 325 mesh silica; from about 1 to about 6 weight percent hydrated aluminum silicate; from about 1 to about 4 weight percent graphite; from about 0.8 to about 0.9 weight percent sodium aluminate; from about 3 to about 5 weight percent magnetite; and, from about 6 to about 10 weight percent water upon mixing.

11. The thermally stable refractory coating of claim 4 wherein said coating comprises about 33 weight percent sodium silicate; about 34 weight percent 80 mesh silica; about 15 weight percent 325 mesh silica; about 3 weight percent hydrated aluminum silicate; about 1 weight percent graphite; about 0.9 weight percent sodium aluminate; about 5 weight percent magnetite; and, about 8 weight percent water.

12. A method of forming a thermally stable refractory coating on an iron-based pipe comprising:

mixing together a solution of fine and coarse silica sand particles of about 80 mesh and about 325 mesh, sodium silicate, hydrated aluminum silicate, graphite, sodium aluminate, magnetite, and water;

coating the exterior and interior surfaces of said pipe with said solution;

disposing said pipe in a first oven for 30 minutes at a temperature of from about 150° C. to about 250° C.;

disposing said pipe in a second oven for about 60 minutes at a temperature of about 600° F.; and, allowing said coating to cool.

13. The method of claim 12 wherein said coating is vitrified.

14. The method of claim 12 wherein said coating is continuous.

15. The method of claim 12 wherein said coating comprises from about 30 to about 35 weight percent sodium silicate; from about 31 to about 36 weight percent 80 mesh silica; from about 12 to about 16 weight percent 325 mesh silica; from about 1 to about 6 weight percent hydrated aluminum silicate; from about 1 to about 4 weight percent graphite; from about 0.8 to about 0.9 weight percent sodium aluminate; from about 3 to about 5 weight percent magnetite; and, from about 6 to about 10 weight percent water upon mixing.

16. The method of claim 12 wherein said coating comprises about 33 weight percent sodium silicate; about 34 weight percent 80 mesh silica; about 15 weight percent 325 mesh silica; about 3 weight percent hydrated aluminum silicate; about 1 weight percent graphite; about 0.9 weight percent sodium aluminate; about 5 weight percent magnetite; and, about 8 weight percent water.

* * * * *